US006957896B2

(12) United States Patent
Burgess

(10) Patent No.: US 6,957,896 B2
(45) Date of Patent: Oct. 25, 2005

(54) APERTURE EDGING MEMBER AND METHOD

(76) Inventor: John David Tilbury Burgess, 13/1 Edward Street, Bondi, New South Wales, 2026 (AU)

( * ) Notice: Subject to any disclaimer, the term of this patent is extended or adjusted under 35 U.S.C. 154(b) by 114 days.

(21) Appl. No.: 10/804,742

(22) Filed: Mar. 19, 2004

(65) Prior Publication Data

US 2004/0177572 A1 Sep. 16, 2004

Related U.S. Application Data

(63) Continuation of application No. 09/786,148, filed as application No. PCT/AU99/00696 on Aug. 27, 1999, now abandoned.

(30) Foreign Application Priority Data

Aug. 28, 1998 (AU) ..... PP5519
Aug. 4, 1999 (AU) ..... PQ2030

(51) Int. Cl.[7] ..... F21S 8/00
(52) U.S. Cl. ..... 362/147; 362/365; 52/220.8
(58) Field of Search ..... 362/145, 147, 362/148, 457; 52/716.1, 39, 28, 717.05, 220.8, 364; 248/27.1, 27.3, 342, 343

(56) References Cited

U.S. PATENT DOCUMENTS 2,218,731 A * 10/1940 Harris et al. ..... 362/309
3,697,742 A * 10/1972 Bobrick ..... 362/366
3,700,885 A * 10/1972 Bobrick ..... 362/366
3,872,296 A * 3/1975 Cohen et al. ..... 362/366
4,175,281 A * 11/1979 Lonseth ..... 362/148
4,250,540 A * 2/1981 Kristofek ..... 362/368
4,274,615 A * 6/1981 Chan et al. ..... 248/343
4,431,151 A * 2/1984 Schonasky ..... 248/27.1
4,475,147 A * 10/1984 Kristofek ..... 362/148
4,862,332 A * 8/1989 Hardy ..... 362/145
5,045,984 A * 9/1991 Trowbridge et al. ..... 362/365
5,309,342 A * 5/1994 Heinen, Sr. ..... 362/364
5,465,199 A * 11/1995 Bray et al. ..... 362/364

* cited by examiner

*Primary Examiner*—Alan Cariaso
*Assistant Examiner*—Ali Alavi
(74) *Attorney, Agent, or Firm*—Cesari and McKenna, LLP

(57) ABSTRACT

The invention relates to the provision of apertures in building board materials, such as in ceiling or walls. A first aspect relates to an aperture edging member for forming a substantially smooth or "flush" aperture within a surface member. The edging member includes a substantially planar rim portion adapted to be attached to the surface member, a lip provided along one edge of the rim, and a flange depending from the lip in a substantially transverse direction to the rim so as to fit within the aperture. The second aspect relates to an aperture edging device which has an intermediate section with a pair of arms depending transversely therefrom to form a substantially c-shaped configuration to envelope the edge portion of the surface member. An advantage is that a strong rigid vertical face is created in the plaster board, minimizing the possibility of damage thereto. Light fittings, or other fittings may be associated with the device.

29 Claims, 7 Drawing Sheets

APERTURE EDGING MEMBER AND METHOD

This application is a continuation of Ser. No. 09/786,148, file Feb. 27, 2001, abandoned, which is a 371 of PCT/AU99/00696 filed Aug. 27, 1999.

TECHNICAL FIELD OF THE INVENTION

The present invention relates to improvements in the provision of apertures in building board materials, such as in ceilings and/or walls.

In one aspect, the present invention relates to a method and apparatus for forming a substantially smooth aperture within a ceiling or wall or other surface member, and also to an apparatus and method for installing a fitting, such as a light fitting, in a manner such that it does not overlay or protrude from said surface member.

In a second aspect, the present invention relates to a method and apparatus for forming a smooth edge in an aperture formed within a surface member.

DESCRIPTION OF THE PRIOR ART

Presently known methods of installing a fitting, such as a light fitting, air conditioning duct, sprinkler, or other fitting in a ceiling, involve forming a cutout in the ceiling, and then supplying the fitting within the cutout. Such known fittings are provided with a flange or the like fabricated by the manufacturer of the fitting, such that, when installed any roughened edge about the cutout is covered by the protruding flange overlying the ceiling surface.

Such a flange may discolour, rust, or begin to separate from the 'line', i.e., the smooth surface, of the ceiling, over time. Furthermore, such a flange also causes a visual disruption to the smooth surface of the ceiling. Not only is this aesthetically unappealing, but, where it is necessary to paint or provide some form of coating to the surface, either the fitting and/or its associated flange must be removed, or, difficulty is encountered avoiding application of the paint or other coating to the flange portion, at least, of the fitting.

SUMMARY OF THE INVENTION

The present invention seeks to provide an apparatus and method for forming a substantially smooth aperture within a surface member, such as a ceiling or a wall, which overcomes the disadvantages of the prior art.

The present invention also seeks to provide an apparatus and method for forming a substantially smooth aperture within the surface member for attaching a fitting thereto but, which allows for elimination of a flange or the like overlaying the surface member.

The present invention also seeks to provide a means for installing a fitting, such as a light fitting, in a ceiling in a manner such that no visual disruption is provided to the line of the ceiling, which has the added advantage that less difficulty is encountered in painting or applying other coatings to the surface member, etc, and, in which the structural rigidity of the aperture is improved.

The present invention also seeks to provide a support member for a light fitting, which is adapted to receive a range of commercially available downlight type light fittings, or which may receive a custom designed fitting in accordance with the present invention.

In one aspect, the present invention provides an aperture edging member for forming a substantially smooth aperture within a surface member, said member including:

- a substantially planar rim portion adapted to be attached to said surface member;
- a lip provided along one edge of said rim; and,
- a flange depending from said lip in a substantially transverse direction to said rim so as to fit within said aperture.

Preferably, at least said rim includes a plurality of perforations, is segmented, castellated, or the like.

Also preferably, said rim is shaped to fit with any desired shape aperture.

Preferably, said rim is substantially annularly shaped so as to fit with a substantially circular aperture.

Preferably, in use, said rim portion is attached to said surface member and a substantially smooth layer of settable material is applied thereover to said lip.

In its preferred form, said surface member is formed of plasterboard, plaster, render or the like, and said settable material includes plaster, render or other settable filler material.

In a further broad form, the present invention seeks to provide a support member for supporting a fitting in an aperture provided within a surface member, including:

- a substantially planar rim portion adapted to be attached to said surface member;
- a lip provided along one edge of said rim; and,
- a flange depending from said lip in a substantially transverse direction to said rim so as to fit substantially within said aperture, said flange incorporating means for attachment of said fitting.

In this preferred form of the invention, at least said rim includes a plurality of perforations, is segmented, castellated, or the like.

Also preferably, said rim is shaped to fit within any desired shaped aperture.

Preferably, said rim is substantially annularly shaped to fit within a substantially circularly shaped aperture.

Also preferably, in use, said rim portion is attached to said surface member and a substantially smooth layer of settable material is applied thereover to said lip.

Preferably, said surface member is a plasterboard, plaster or rendered surface.

Most preferably, said settable material includes plaster, render or other filler material.

In a preferred embodiment, said fitting is a light fitting, such as a downright fitting.

In alternatively preferred embodiments, said fitting is an air conditioning or heating or other vent, a speaker, a sprinkler, or any other fitting normally attached to a ceiling or wall surface.

Perhaps most preferably, said support member is formed of sheet metal material.

Also preferably, said support member is formed of plastics material.

In yet a further broad form, the present invention provides a recessed lighting device adapted to be provided within an aperture of a surface member, including:

- a support member having:
  - a substantially planar rim portion adapted to be attached to said surface member;
  - a lip portion provided along one edge of said rim;
  - a flange depending from said lip in a substantially transverse direction to said rim so as to fit substantially with said aperture; and,
  - a light fitting having lamp means adapted to be releasably attached to said attachment means in a manner such that it is recessed within said aperture relative to said surface member.

In this preferred form, said light fitting includes a lamp housing including a flange having a central aperture to receive said lamp means, wherein said lamp housing is provided with engagement means to engage with said attachment means of said support member.

Preferably, said engagement means is embodied as a biased clip means adapted to engage with said attachment means associated with said flange.

Also preferably, said attachment means is formed by an outer edge of said flange.

In yet a further broad form, the present invention provides a method of forming an aperture in a surface member, comprising the steps of:

forming a cutout in said surface member;

inserting and attaching an aperture member within said cutout, said aperture member including, a substantially planar rim portion, a lip provided along one edge of said rim, and, a flange depending from said rim, in a manner whereby said rim portion is attached to said surface member about said cutout such that said flange fits about said cutout; and, providing a layer of settable material over said rim to said lip.

Preferably, said cutout is formed of any desired shape, and wherein an aperture member of corresponding shape is inserted within said cutout.

Also preferably, said cutout is of substantially circular shape, and wherein an aperture member having a rim of substantially annular shape is provided within said cutout.

Preferably, said surface member is plasterboard, plaster or a rendered surface, and wherein said settable material includes plaster, render or other filler material.

In yet a further broad form, the present invention provides a method of installing a recessed fitting in a surface member, comprising the steps of:

forming a cutout in said surface member:

inserting and attaching a support member in said cutout, wherein said support member includes, a substantially planar rim portion adapted to be attached to said surface member, a lip providing along one edge of said rim, a flange depending from said rim in a substantially transverse direction to said rim so as to fit within said aperture, and, attachment means associated with said flange for attachment of said fitting;

providing a layer of settable material over said rim to said lip; and, attaching said flange to said attachment means of said flange.

Preferably, said cutout is formed of any desired shape, and wherein an aperture member of corresponding shape is inserted within said cutout.

Also preferably, said cutout is of substantially circular shape, and wherein an aperture member having a rim of substantially annular shape is provided within said cutout.

In a preferred embodiment, said surface member is plasterboard, plaster or a rendered surface, and wherein said settable material includes plaster, render or other fillable material.

Preferably, characterised in that said fitting is a light fitting.

Also preferably, characterised in that said fitting is an air conditioning, heating or other vent, a speaker, a sprinkler, or any other fitting normally installed in a ceiling or wall surface.

In another aspect, the present invention provides an aperture edging device for edging an aperture formed within a surface member, including an intermediate section and a pair of flange arms depending transversely therefrom, to form a substantially c-shaped configuration to envelope the edge portion of said surface member.

Preferably, said surface member is building board, including plasterboard, fibre cement, compressed fibre cement, composite sheet material, or the like.

Also preferably, said device is of substantially annular shape.

Also preferably, said device is provided with a cut or split or the like to facilitate insertion of said device within an aperture formed in said surface member.

In a preferred form, said intermediate section is formed of a pair of attachable members.

In yet a further preferred form, said members are releasably attachable.

Most preferably, at least one of said arms depends from said intermediate section at an acute angle such that it is inwardly biased towards said surface member, to assist in retention of said device on said surface member.

Also preferably, one of said arms has its outer extremity outwardly directed to assist in installation of said device over said edge of said surface member.

In a preferred form, a longitudinally extending lip is provided on one end of said intermediate member.

Preferably, said device is formed of flexible, bendable and/or resilient material such as plastics.

BRIEF DESCRIPTION OF THE DRAWINGS

The present invention will become more fully understood from the following detailed description of a preferred but non-limiting embodiment, described in connection with the accompanying drawings, wherein.

DETAILED DESCRIPTION OF PREFERRED EMBODIMENTS

Figure 1:
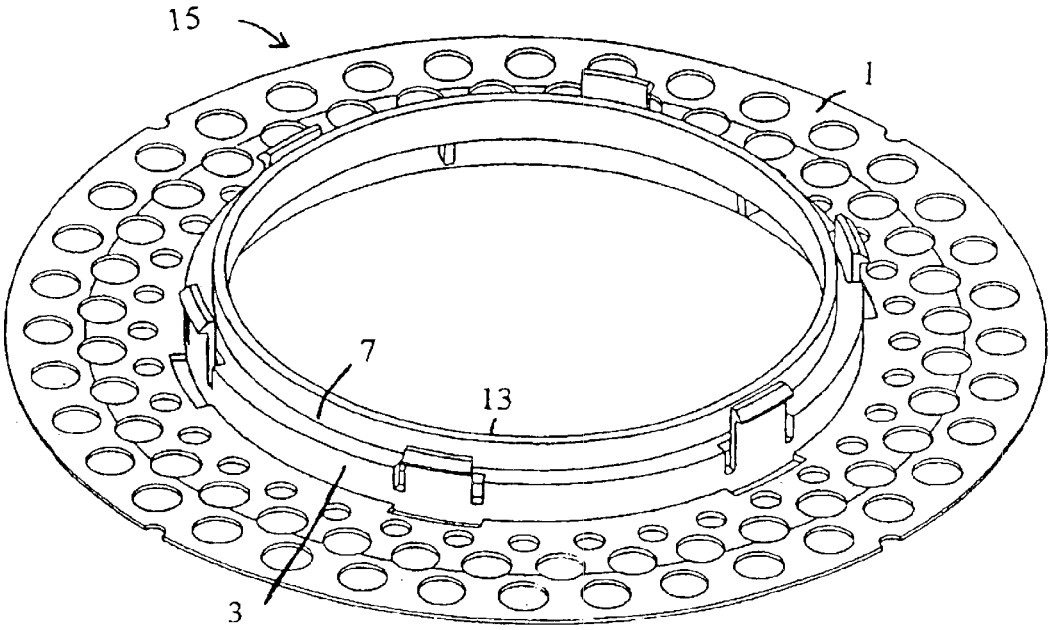
FIG. 1 illustrates a perspective view of a support member for supporting a light fitting, in accordance with a preferred but non-limiting embodiment of the present invention.
Figure 4:
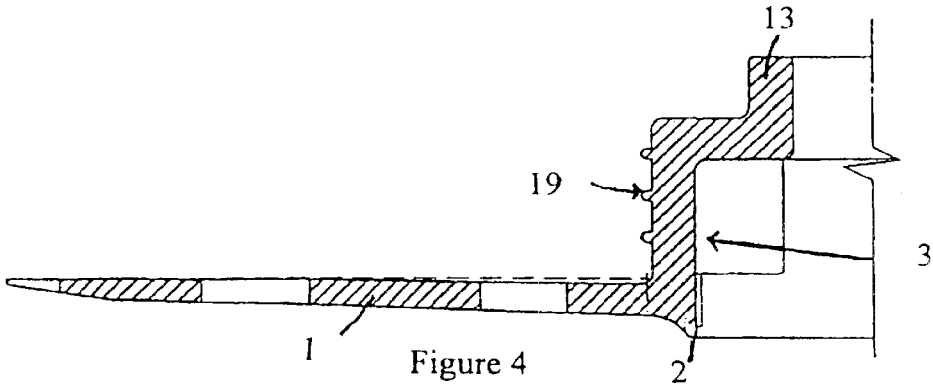
FIG. 4 illustrates an enlarged cross-sectional view of the profile of the support member of FIG. 1.
Figure 2:
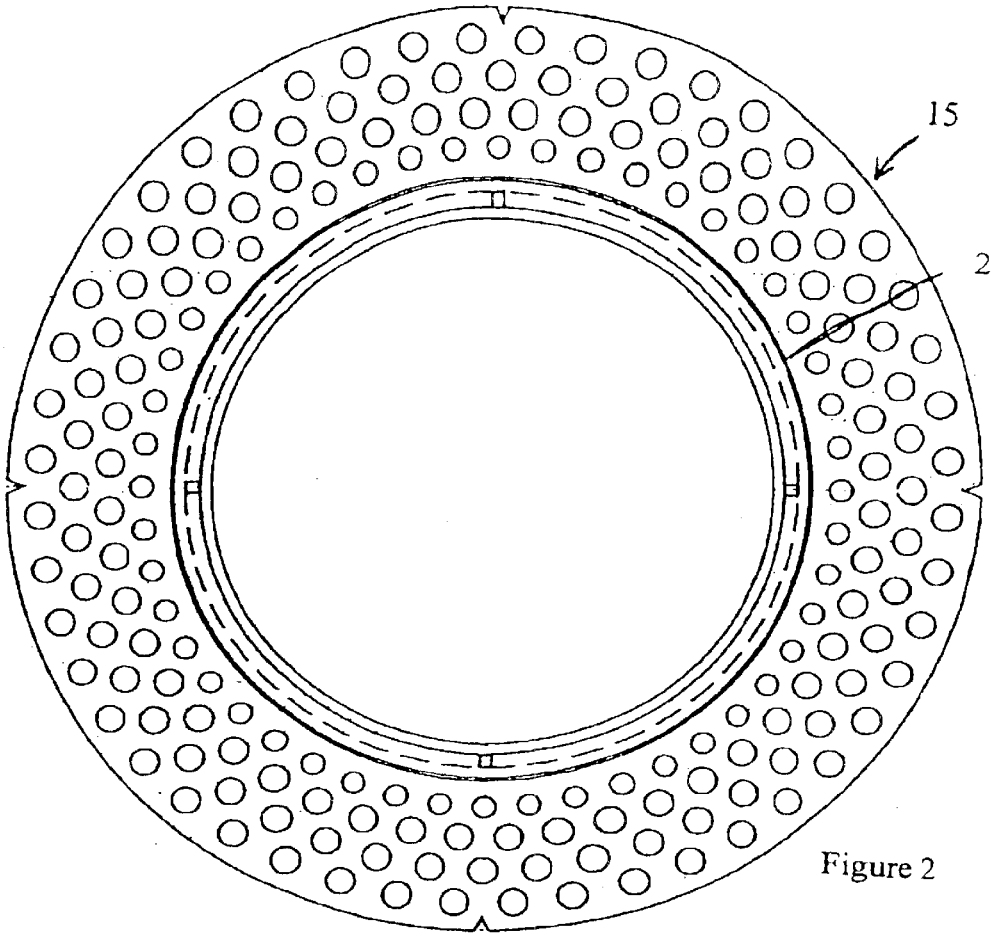
FIG. 2 illustrates a plan view of the support member of FIG. 1.
Figure 3:
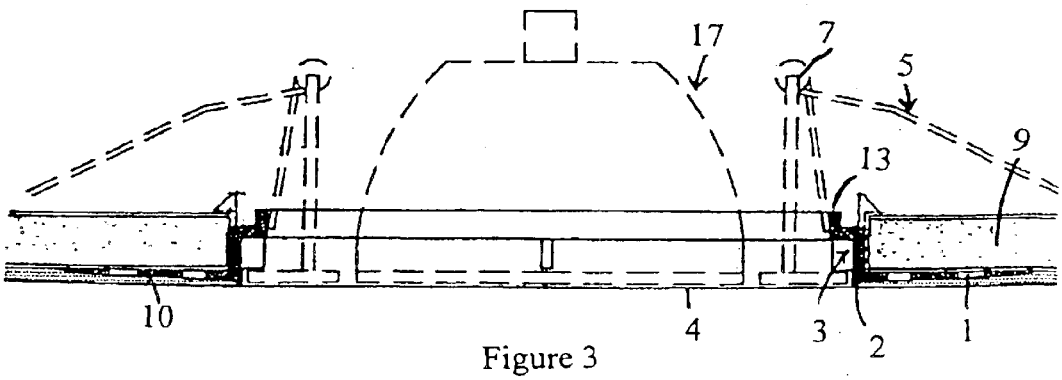
FIG. 3 illustrates a cross-sectional view through the support member shown in FIG. 2, showing the positioning of a light fitting therein.
Figure 6:
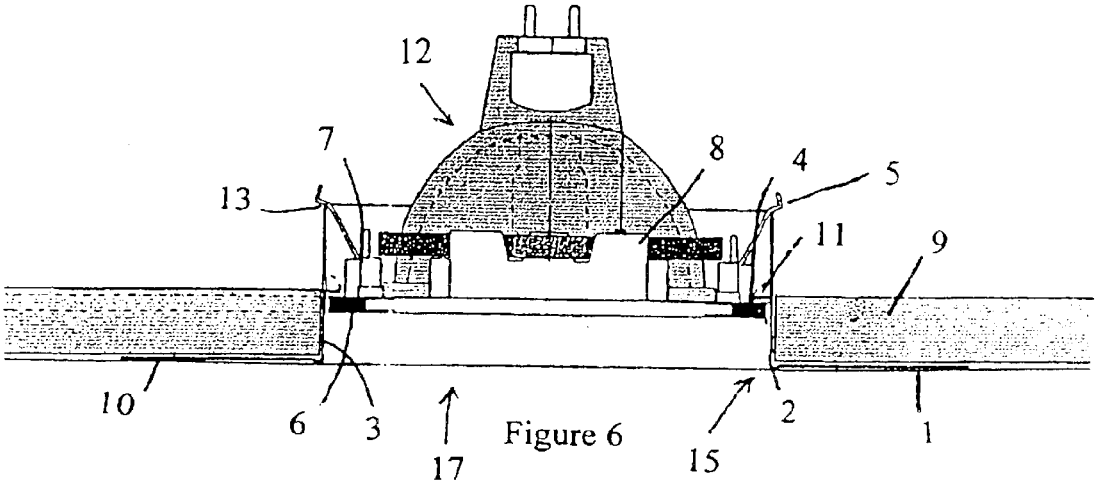
FIG. 6 illustrates a cross-sectional view of the embodiment of FIG. 5.
Figure 5:
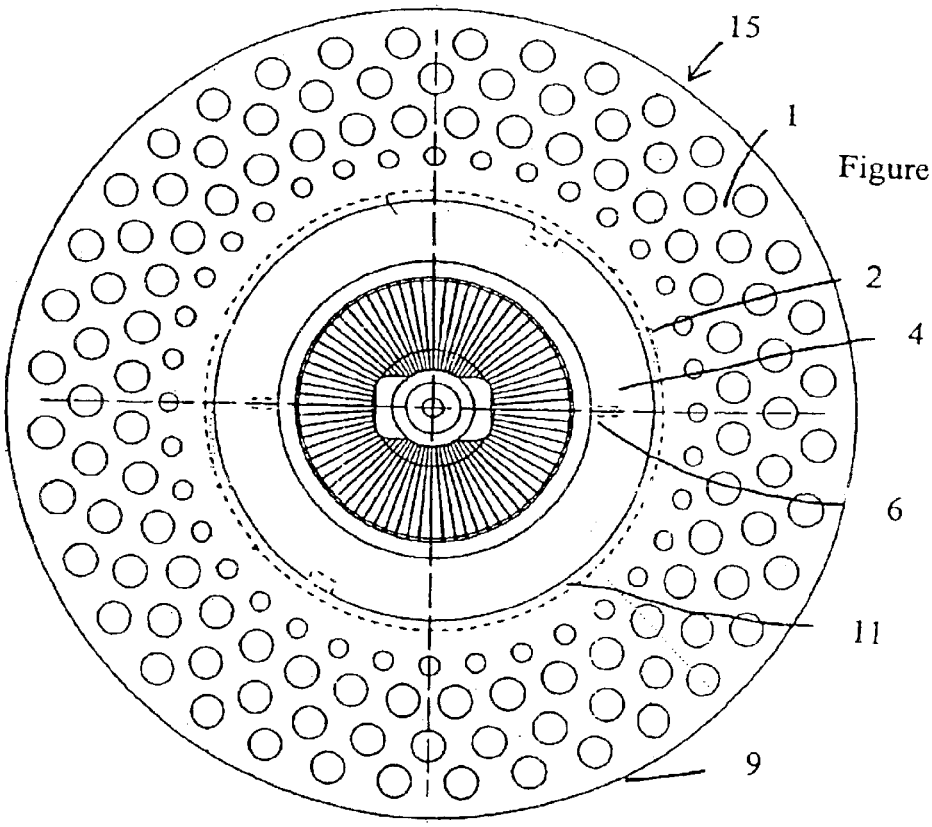
FIG. 5 illustrates a plan view of an alternative embodiment of the invention.

Throughout the drawings, like numerals will be used to identify similar features, except where expressly otherwise indicated.

It will be understood that a first aspect of the invention is described with reference to FIGS. 1 to 7, whilst a second aspect of the invention is described with reference to FIGS. 8 to 11.

As illustrated in the FIGS. 1 to 7 of the drawings, a support member 15 for supporting a light fitting or other fitting to a cutout in a surface member is shown, which includes a substantially planar rim portion 1, a lip 2 provided along one edge of the rim 1, and a flange 3, depending from the lip in a substantially orthogonal direction to the plane of rim 1.

A light fitting 17 may be installed within the support member 15, and be retained therein by suitable attachment means. The arrangement illustrated in the drawings includes an attachment means, which is embodied in the drawings as a flange 7. The light fitting may be in the form of a conventional type downlight as presently commercially available, or may be custom designed to particularly suit the support member. In the embodiment shown, a conventional downlight is shown, including a housing 4 which is typically made of cast aluminium, which may be polished and sealed or painted, with a central aperture to suit the lamp 12. To retain the lamp 12 and lamp housing 4 within the support member 15, spring clips 5, held in place by cleats 7, may be provided which catch over the top edge 13 of flange 3. The cleats 7 may be fixed to the inner face of the lamp housing. It will be appreciated by persons skilled in the art that any alternative form of attachment means for retaining the lamp 12 within a support member, may be utilised. For example, a cleat and spring circlip 8 may be utilised to retain the lamp 12 in position, in conjunction with cleats 7, such as in the arrangement of Fig. 6. The upper end of flange 3 may be inwardly bent, as indicated by protrusion 11, against which the edge 4 of the light fitting 12 may abut.

It will be understood that a unique feature of this aspect of the present invention is the ability to provide a 'smooth' finished surface 10 right up to the lip 2 of the device 15. When the term 'smooth' is used in this context throughout the specification, it should be understood that what is intended in that there is no visually noticable protruding flange or the like required to be provided overlaying the surface 10. Consequently, a continuous paintable finish right up to the light fitting aperture is provided, resulting in a smooth flush fitting, or a recessed fitting, but with no visual disruption to the line of the ceiling.

The rim 1 may be attached to the surface member 9, by inbuilt fastening clips, or like means, or, by using adhesives, screws, nails or any other conventional means. Appropriate roughening or projections 19 may be optionally provided on any of the surfaces of the support member to assist in bending or for improved strength or rigidity. The rim 1 is preferably perforated in a similar manner to the way in which corner edging pieces are perforated when forming corners on plasterboard walls. Alternatively, the rim may be segmented, castellated, or the like. The other components may likewise be perforated, segmented, castellated, or the like. The rim 1 is therefore attached to the surface member 9, and then settable material 10, such as plaster, or other filler material, is supplied over the surface member 9 right up to the lip 2.

It will be appreciated that a fitting of any desired shape may be installed into a member of appropriate complementary shape. This may include conventional type circular downlights, whereby the rim would typically be of substantially annular shape, or, any other shape may be provided. This may embody the ability to mould the support member in a variety of shapes depending upon the fitting to be installed. Lights of any desired shape such as rectangular, square, oval, triangle, or any other freeform shape, may therefore be installed, including uniquely shaped designs such as corporate logos, etc.

Whilst the present invention is particularly useful for providing apertures in plasterboard ceilings, it will be appreciated that the invention may alternatively be applied to walls or other surface members. Furthermore, it will be appreciated that such fittings may be applied to rendered surfaces, or any other surface which might typically utilise a settable material, such as a plaster, render, or other filler material.

The support member 15 may be formed of sheet metal material, plaster, plastics, cardboard or any other suitable material. It will be appreciated that whilst sheet metal material might have the advantage of providing higher structural rigidity, when forming unusual shapes, plastics, plaster, or resin impregnated cardboard may be more preferable in being more easily formed to be of any desired shape. Other materials will become understood to be able to be used, by persons skilled in the art.

Whilst the embodiment hereinbefore described is related to a support member for supporting a fitting in a cutout provided within a surface member, it will be appreciated that an alternative embodiment of the invention would be wherein an aperture is desired to be formed within a surface member, wherein the aperture is desired to provide such a smooth (flush) uninterrupted surface, right up to the edge of the aperture, but wherein no fitting is actually desired to be installed. As such, the present invention should be understood to also incorporate such an aperture edging member, for forming such a smooth aperture within the surface member, which incorporates the substantially planar rim adapted to be attached to the surface member, the lip 3 provided about the edge of the rim, and which has a flange 3 depending from the lip in a substantially orthogonal or other transverse direction to the rim, so as to fit within the aperture. It will be appreciated that it may be desirable to provide such apertures simply for aesthetic reasons, or for other purposes. It will also be understood that whilst the embodiment illustrated in the drawings provides the flange 3 to be substantially orthogonal to the rim member 1, that other transverse angles other than orthogonal may also be provided depending upon the particular aperture and/or fitting desired to be installed.

It will be understood by persons skilled in the art that the method of forming the aperture and/or installing the recessed fitting in the surface member includes the primary step of forming a cutout in the surface member, then installing and attaching an aperture member or support member within the cutout, wherein the aperture member includes the substantially planar rim portion 1, the lip 2, and the flange 3, in such a manner whereby the rim portion is attached to the surface member about the cutout, such that the flange fits within the cutout. Thereafter, a layer of settable material is provided over the rim to the lip, and, in the instance where a recessed fitting, such as a light fitting, is adapted to be installed, the fitting is then attached by suitable attachment means to the flange 3.

Figure 7:
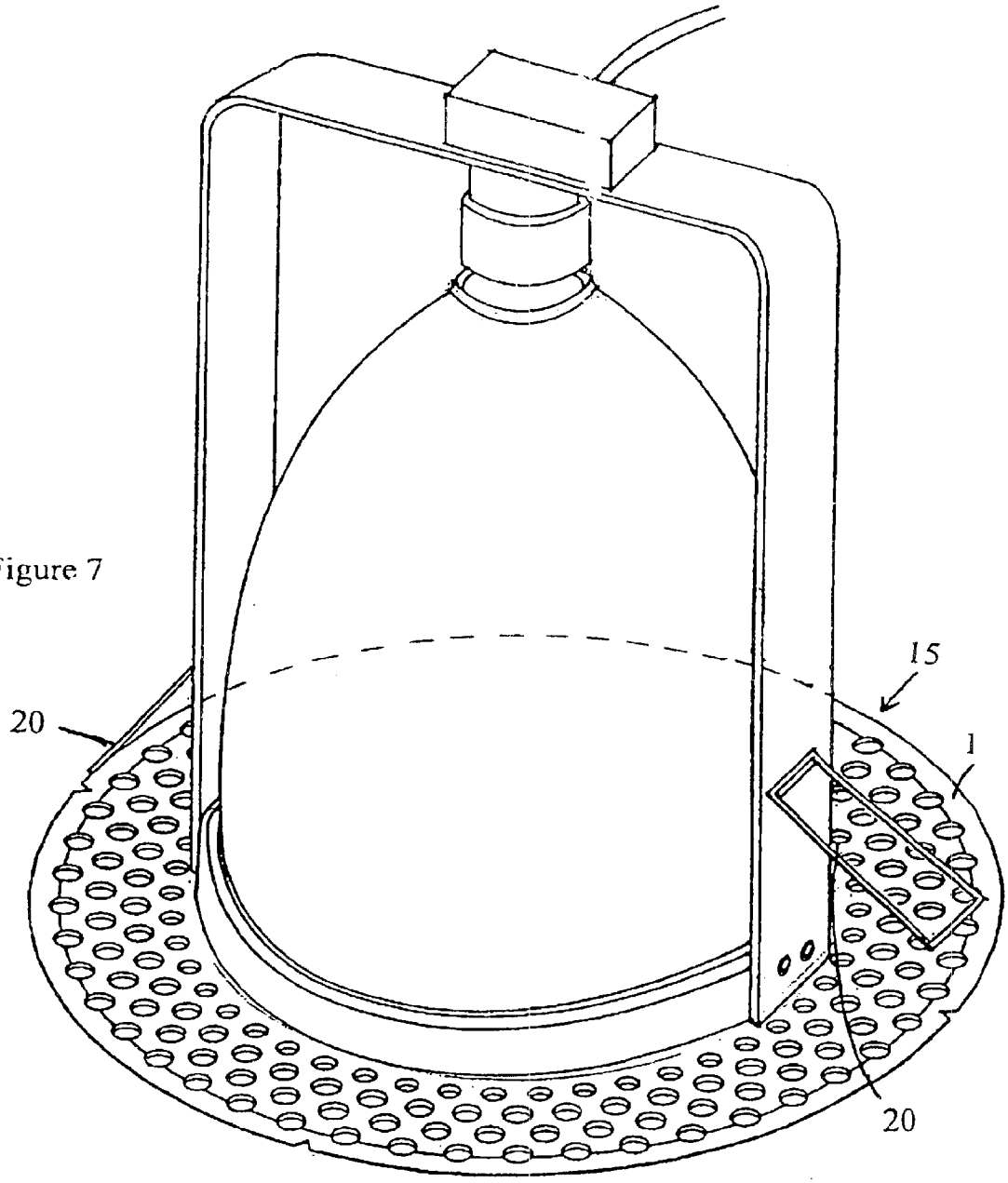
FIG. 7 illustrates an alternative embodiment of the invention, showing a support member having an alternative support structure associated therewith.
Figure 8:
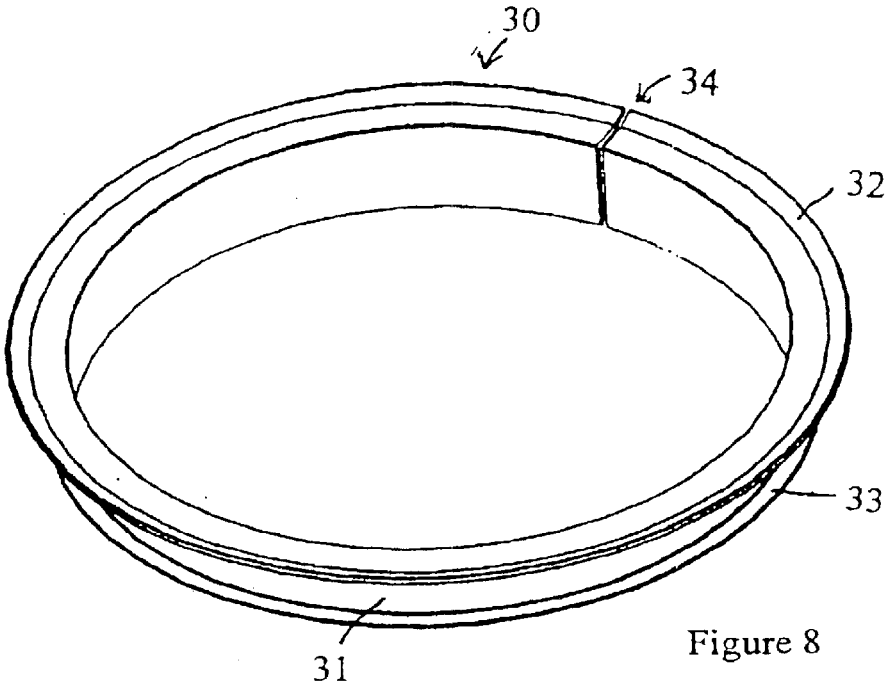
FIG. 8 illustrates a perspective view of an aperture edging member for edging an aperture formed in a surface member in accordance with a second aspect of the present invention.
Figure 11A:
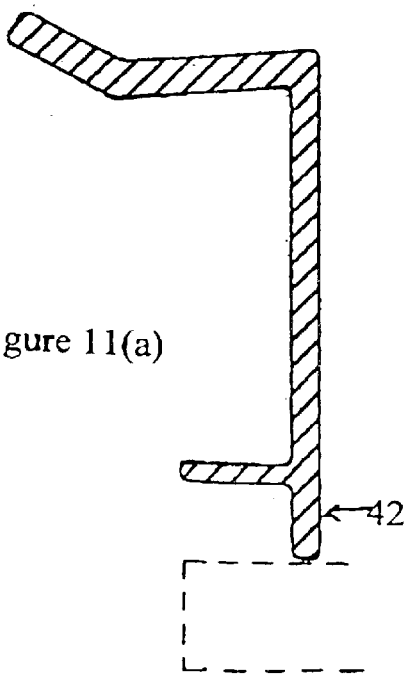
Figure 11B:
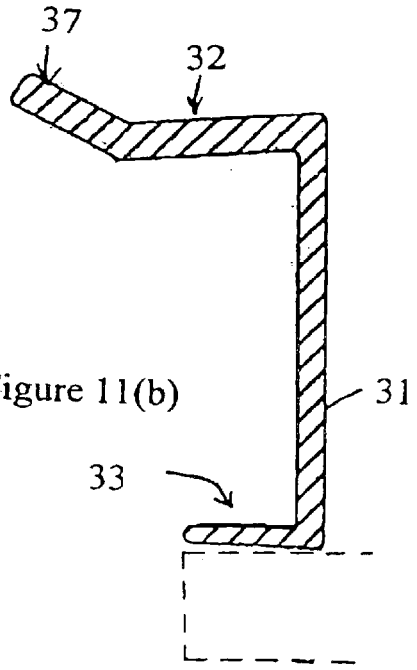
Figure 9:
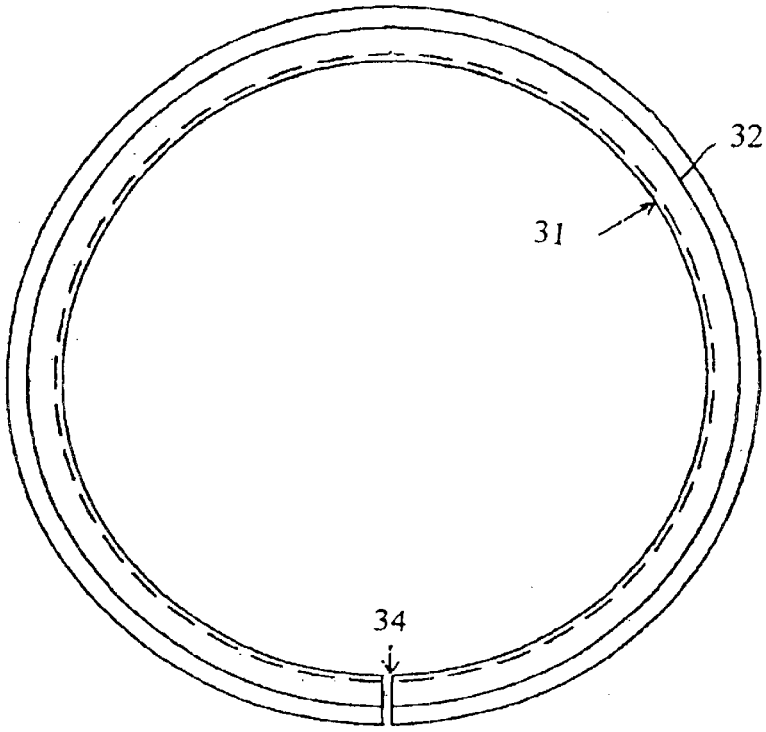
FIG. 9 illustrates a plan view of the device of FIG. 8.

A variation to the invention is to incorporate an inbuilt support structure associated with the flange 1, in the manner illustrated in FIG. 7. Rather than attaching a commercially available down light or recessed light using a spring clip 5, a custom built light fitting may be designed. In such an arrangement, the fitting 15 may be supported by support clips 20, particularly whilst the plaster or other material is setting.

Various alterations and modifications to the embodiments hereinbefore described will become apparent to persons skilled in the art. For example, a fire-rated downlight construction, wherein a totally enclosed housing surrounds the light fitting, with an appropriate orifice for wires to pass through, is envisaged. Such a housing may be formed of the same type of material as the ceiling, for example, fire-rated plasterboard or metal, and be attachable atop the plasterboard ceiling using the support member arrangement of the present invention.

It will be appreciated that this first aspect of the present invention therefore provides an apparatus and method which is particularly useful in providing a unique means and method of illuminating in providing a smooth surface profile, which is readily incorporated into ceilings and/or walls, using conventional building techniques. The fittings described in the present invention allow the surface plane and the colour to be broken only by the aperture for such a light source.

As illustrated in FIGS. 8 to 11 of the drawings, the aperture edging device, in accordance with a second aspect of the present invention, generally designated by the numeral 30 comprises an intermediate portion 31, a pair of flange arms 32 and 33 which depend transversely from the intermediate section 31 to form a substantially c-shaped configuration when viewed in cross-section (See FIG. 11). The aperture edging device is adapted to be inserted into an aperture formed within a surface member, such as building board, which, for example, might include plasterboard, fibre cement, compressed fibre cement, composite sheet material or the like. When an aperture is used to provide a light fitting, the device of the present invention is preferably formed to be of annular shape. It will however be appreciated that apertures of any desired shape may be formed, and that therefore any desired aperture edging device, in accordance with the present invention, may be formed of any desired shape.

Figure 10:
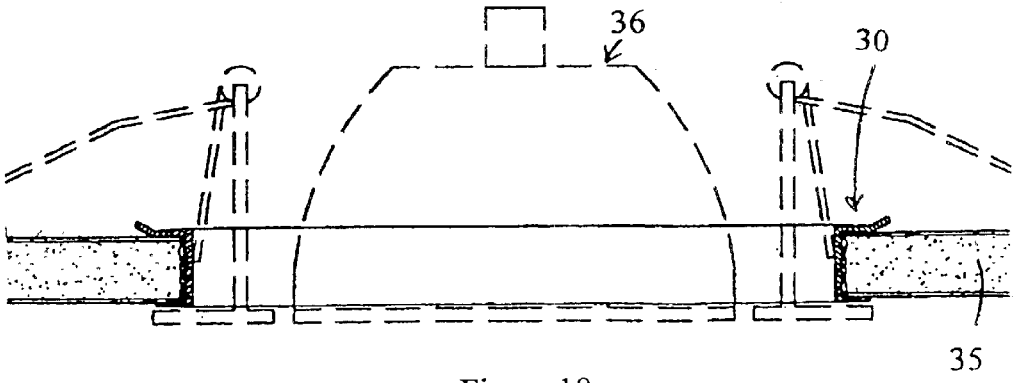
FIG. 10 illustrates a cross-sectional view, showing the positioning of a light fitting; and, FIG. 11 illustrates various enlargements of the cross-sectional profile of the aperture edging member.
Figure 11C:
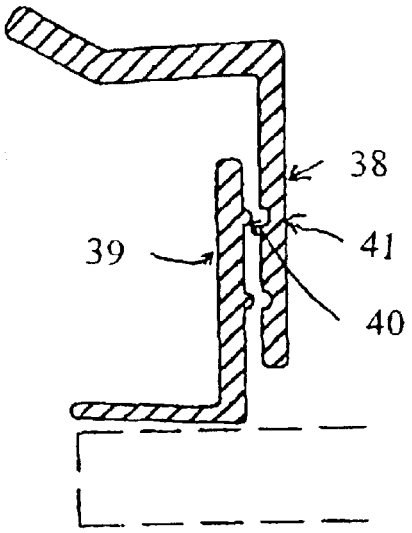
Figure 11E:
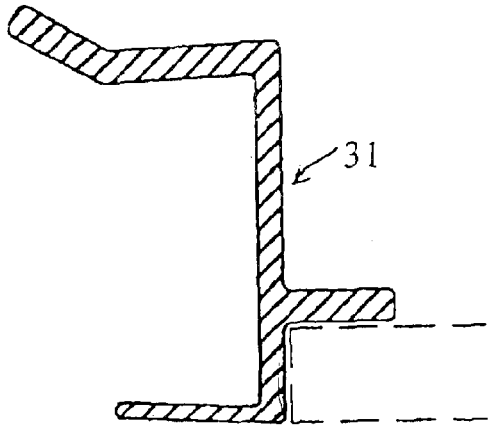
Figure 11D:
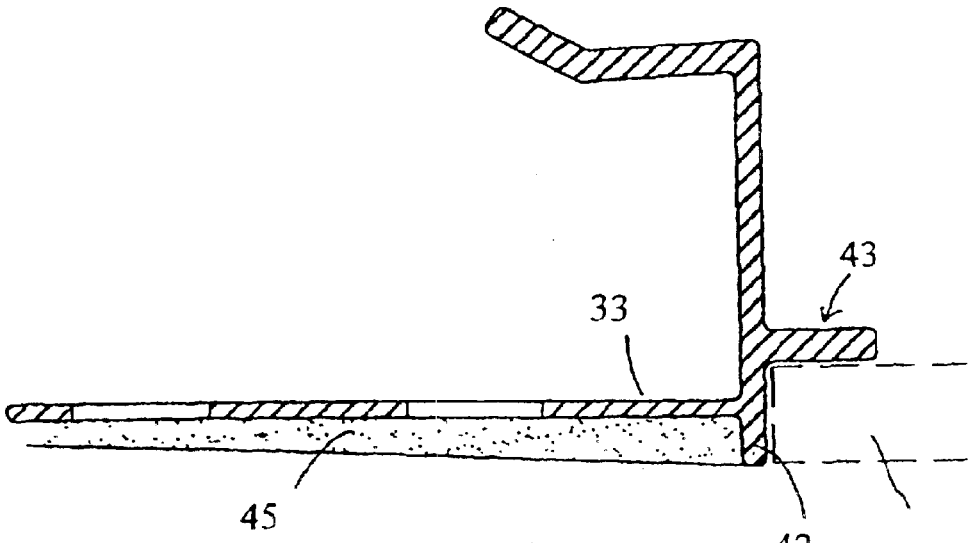

In a preferred embodiment, the device may be provided with a cut or split 34, which may facilitate insertion of the device 30 within the aperture. It may also be formed whereby at least part of the device is of a solid body formation, or may have perforations, segments or castellations. In FIG. 10 is illustrated the aperture edging device 30 installed in an aperture within a building board, for installation of a light fitting 36, whilst enlarged cross-sectional profiles of the device 30 is shown in FIG. 1. As illustrated in FIG. 11, the device, in cross-section forms a c-shape (or inverse c-shape when viewing from the opposed direction). Whilst it will be appreciated that the arms may either depend substantially orthogonal from the intermediate member, in a preferred form, the arms, or at least one of them, may extend at an angle slightly less than 90°, such that the device is inwardly biased to be retained on the building board. Also, in a preferred form, the outer extremity 37 of one of the flange arms 32 is outwardly directed to assist installation of the device over the edge of the board.

FIG. 11(*a*) illustrates the provision of a lip 42 extending longitudinally from the intermediate member. This may be formed such that the fitting sits proud of the ceiling plane. This allows for ease of painting, etc. FIG. 11(*b*) illustrates a similar arrangement to FIG. 11(*a*), but without the lip 42. FIG. 11*c* illustrates an alternative embodiment wherein the intermediate section is formed of a pair of attachable members 38 and 39. In a preferred embodiment, the members 38 and 39 may be clipped or otherwise attached to one another by suitable engagement members 40 and 41, and this may be performed in a permanent or releasable manner. Whilst this arrangement overlaps the ceiling, it benefits by providing a strong aperture edging. FIG. 11(*d*) illustrates a variation, but including an abutment flange 43, against which a light fitting 44 or other fitting may abut. FIG. 11(*d*) also shows the provision of the lip 42 to which settable material 45 may be provided. Also, shown is that the flange arm 33 is perforated. It may alternatively be formed in an other than solid manner, with appropriate segments, castellations, or the like. FIG. 11(*e*) shows another variation, but without the lip 42.

It will be appreciated that the intermediate portion 31 may incorporate means for attachment of a light fitting, by a screw-in, clipping or other engaging mechanism.

It will be appreciated that the aperture edging device of the present invention uniquely provides a device which forms a smooth edge on an aperture in a boarding material, such as plasterboard, or the like. The device provides protection against the destruction or decay of the edge of the plasterboard or like material, and optionally also provides the ability to then install a light fitting or the like about the edge of the device, whereby the edge of the device is provided with improved structural integrity. Once a rigid and vertical face has been formed in the building board the methods of fixing fixtures may be changed. This system provides the introduction of threads, keys or similar male/female components to the fixture and aperture trim. These systems of restraint allow for more rapid installation and removal of fixtures of fixtures without damaging the board into which they are housed.

The present invention has been hereinbefore described with reference to a particular embodiment only. It will, however, be understood by persons skilled in the art, that numerous variations and modifications can be made to the invention. All such variations and modifications should be considered to be within the scope of the invention as broadly hereinbefore described.

What is claimed is:

1. An aperture edging member for forming a substantially smooth aperture within a surface member, said edging member being formed as a unitary member of complementary shape to surround the entire periphery of an orifice formed in said surface member, the aperture edging member including:

a substantially planar rim having inner and outer edges and which is perforated, segmented or castellated, and which is adapted to be attached over a portion of said surface member about said orifice formed in said surface member;

a lip extending outwards from said inner edge of said rim to a lip extremity such that, following installation, a layer of settable material is adapted to be applied over said rim from the lip extremity at least to said outer edge of the rim to form a surface finish over said rim which is substantially flush with the remainder of the surface member not covered by said rim, and a flange extending orthogonally from the inner edge of the rim in the opposite direction from said lip so as to fit within said orifice and thereby define an inner surface of said orifice which extends substantially orthogonally to said surface finish.

2. An aperture edging member as claimed in claim 1, wherein said flange is substantially annularly shaped so as to fit within a substantially circular orifice.

3. An aperture edging member as claimed in claim 1, wherein said surface member is formed of plasterboard, plaster or render, and said settable material includes plaster, render or other settable filler material.

4. A support member for supporting a fitting in an orifice provided within a surface member, said support member being formed as a unitary member of complementary shape to surround the entire periphery of an orifice formed in said surface member, the support member including:

a substantially planar rim having inner and outer edges and which is perforated, segmented or castellated, and which is adapted to be attached over a portion of said surface member about said orifice formed in said surface member;

a lip extending outwards from said inner edge of said rim to a lip extremity such that, following installation, a layer of settable material is applied over said rim from said lip extremity at least to said outer edge of the rim to form a surface finish over said rim which is flush with the remainder of the surface member not covered by said rim, and a flange extending orthogonally from said inner edge of the rim in the opposite direction from said lip so as to fit within said orifice and thereby define an inner surface of said orifice which extends substantially orthogonally to said surface finish, said flange incorporating means for attachment of said fitting.

5. A support member as claimed in claim 4, wherein said flange is substantially annularly shaped to fit within a substantially circularly shaped orifice.

6. A support member as claimed in claim 4 or 5, wherein said surface member is a plasterboard, plaster or rendered surface.

7. A support member as claimed in claim 4 or 5, wherein said settable material includes plaster, render or other filler material.

8. A support member as claimed in claim 4 or 5, wherein said fitting is a light fitting, including a downlight fitting.

9. A support member as claimed in claim 4 or 5, wherein said fitting is an air conditioning or heating or other vent, a speaker, a sprinkler, or any other fitting normally attached to a ceiling or wall surface.

10. A support member as claimed in claim 4 or 5, wherein said support member is formed of sheet metal material.

11. A support member as claimed in claim 4 or 5, wherein said support member is formed of plastics material.

12. A lighting device adapted to be provided within an orifice of a surface member, including a support member being formed as a unitary member of complementary shape to surround the entire periphery of an orifice formed in said surface member, said device including:

a substantially planar rim having inner and outer edges and adapted to be attached over a portion of said surface member about said orifice formed in said surface member, the rim being perforated, segmented or castellated;

a lip extending outwards from said inner edge of said rim to a lip extremity, such that, following installation, a layer of settable material is provided over said rim from said lip extremity at least to said outer edge of the rim to form a surface finish over said rim which is flush with the remainder of the surface member not covered by said rim, and a flange extending substantially orthogonally from said inner edge in a direction opposite that of said lip so as to fit substantially within said orifice and thereby define an inner surface of said orifice which extends substantially orthogonally to said surface finish, said device also including lamp means adapted to be releasably attached to attachment means associated with said flange in a manner such that said lamp means is substantially aligned with said orifice.

13. A lighting device as claimed in claim 12, wherein said device includes a lamp housing including a flange having a central aperture to receive said lamp means, wherein said lamp housing is provided with engagement means to engage with said attachment means of said support member.

14. A lighting device as claimed in claim 13, wherein said engagement means is embodied as at least two biased arms adapted to extend over and engage with the edge of said flange.

15. A lighting device as claimed in claim 13 or 14, wherein said support member is attached to said surface member by biased retaining means adapted to engage with said surface member.

16. A lighting device as claimed in claim 15, wherein said biased retaining means is formed with a protruding portion adapted to provide support from and clamp over a rear surface of said surface member.

17. A lighting device adapted to be provided within an orifice of a surface member, said device being formed as a unitary member of complementary shape to surround the entire periphery of an orifice formed in said surface member, the lighting device including:

a substantially planar rim having inner and outer edges and adapted to be attached over a portion of said surface member about said orifice formed in said surface member, the rim being perforated, segmented or castellated;

a lip portion extending outwards from said inner edge of said rim to a lip extremity, such that, following installation, a layer of settable material is provided over said rim from said lip extremity at least to said outer edge of the rim to form a surface finish over said rim which is substantially flush with the remainder of the surface member not covered by said rim; and a flange extending orthogonally from said inner edge in a direction opposite that of the lip so as to fit substantially within said orifice and thereby define an inner surface of said orifice which extends substantially orthogonally to said surface finish, and a lamp housing affixed thereto in a manner such that when installed it is recessed within said orifice relative to said surface member.

18. A lighting device as claimed in claim 17, wherein said device is provided with support means to at least partly support said device in its desired position during and after installation within said orifice.

19. A lighting device as claimed in claim 17 or 18, wherein said support means is embodied as biased clip means adapted to engage with an opposed side of said surface member.

20. A method of forming an aperture in a surface member, including the steps of:

cutting an orifice in said surface member;

inserting and attaching a continuously formed aperture member within said orifice, said aperture member including a substantially planar rim having inner and outer edges and which is perforated, segmented or castellated, and which is adapted to be attached over a portion of said surface member about said orifice formed in said surface member;

a lip extending outwards from said inner edge of said rim to a lip extremity such that, following installation, a layer of settable material is adapted to be ap plied over said rim from said lip extremity at least to said outer edge of the rim to form a surface finish over said rim which is flush with the remainder of the surface member not covered by said rim, and a flange extending substantially orthogonally from said inner edge of the rim in a direction opposite that of said lip so as to fit within said orifice and thereby define an inner surface of said orifice which extends substantially orthogonally to said surface finish, and applying a layer of settable material over said rim from said lip extremity at least to the outer edge of said rim.

21. A method of forming an aperture in a surface member as claimed in claim 20, wherein said orifice is formed of any desired shape, and wherein a said flange of corresponding shape is inserted within said orifice.

22. A method of forming an aperture in a surface member as claimed in claim 20, wherein said orifice is of substantially circular shape, and wherein a said flange of substantially annular shape is provided within said orifice.

23. A method of forming an aperture in a surface member as claimed in any one of claims 20 to 22, wherein said surface member is plasterboard, plaster or a rendered surface, and wherein said settable material includes plaster, render or other filler material.

24. A method of installing a recessed fitting in a surface member, including the steps of:

cutting an orifice in said surface member;

inserting and attaching a support member in said orifice, said support member being formed as a unitary member of complementary shape to surround the entire periphery of an orifice formed in said surface member, the support member including:

a substantially planar rim having inner and outer edges and which is perforated, segmented or castellated, and which is adapted to be attached over a portion of said surface member about said orifice formed in said surface member;

a lip extending outwards from said inner edge of said rim to a lip extremity such that, following installation, a layer of settable material is applied over said rim from said lip extremity at least to said outer edge of the rim to form a surface finish over said rim which is of substantially flush appearance to the remainder of the surface member not covered by said rim, and a flange extending substantially orthogonally from said inner edge of the rim in a direction opposite that of the lip so as to fit within said orifice and thereby define an inner surface of said orifice which extends substantially orthogonally to said surface finish, said flange incorporating means for attachment of said fitting;

providing a layer of settable material over said rim from said lip extremity beyond said outer edge of the rim, and attaching said fitting to said attachment means of said flange.

25. A method of installing a recessed fitting in a surface member as claimed in claim 24, wherein said orifice is formed of any desired shape, and wherein a said flange of corresponding shape is inserted within said orifice.

26. A method of installing a recessed fitting in a surface member as claimed in claim 24, wherein said orifice is of substantially circular shape, and wherein a said flange of substantially annular shape is provided within said orifice.

27. A method of installing a recessed fitting in a surface member as claimed in any one of claims 24 to 26, wherein said surface member is plasterboard, plaster or a rendered surface, and wherein said settable material includes plaster, render or other fillable material.

28. A method of installing a recessed fitting in a surface member as claimed in any one of claims 24 to 26, characterised in that said fitting is a light fitting.

29. A method of installing a recessed fitting in a surface member as claimed in any one of claims 24 to 26, characterised in that said fitting is an air conditioning, heating or other vent, a speaker, a sprinkler, or any other fitting normally installed in a ceiling or wall surface.

* * * * *